US006540099B2

(12) United States Patent
Lu

(10) Patent No.: US 6,540,099 B2
(45) Date of Patent: Apr. 1, 2003

(54) SEALING PLUG FOR A WATER GLOBE

(76) Inventor: Lay Lu, 3275 Maurice Ave., Santa Clara, CA (US) 95051

( * ) Notice: Subject to any disclaimer, the term of this patent is extended or adjusted under 35 U.S.C. 154(b) by 72 days.

(21) Appl. No.: 09/795,994

(22) Filed: Feb. 28, 2001

(65) Prior Publication Data

US 2002/0117506 A1 Aug. 29, 2002

(51) Int. Cl.[7] ..... A01G 5/04; A47G 7/02; B65D 23/12; B65D 39/04

(52) U.S. Cl. ..... 220/801; 220/DIG. 19; 215/270; 215/271; 215/358; 47/69

(58) Field of Search ..... 215/270, 271, 215/355, 358, 227, 381–384; 220/801, DIG. 19; 47/41.01, 69

(56) References Cited

U.S. PATENT DOCUMENTS 2,226,951 A * 12/1940 Simpson ..... 47/41.01
2,361,423 A * 10/1944 Snyder ..... 215/227
2,723,041 A * 11/1955 Hart-still ..... 215/271
4,221,078 A * 9/1980 Latham et al. ..... 47/41.01
4,293,078 A * 10/1981 Percarpio et al. ..... 215/247
4,771,902 A * 9/1988 Teng ..... 215/227
4,901,875 A * 2/1990 Teng ..... 215/271
5,775,529 A * 7/1998 Lo ..... 215/271

* cited by examiner

*Primary Examiner*—Nathan J. Newhouse
(74) *Attorney, Agent, or Firm*—Roger C. Turner

(57) ABSTRACT

A sealing plug, for a water globe having a lower opening therein with an extended skirt thereon, having a fixed peripheral portion for sealing the container and supporting an object within the container and having a flexible diaphragm adapted to adjust for changes in volume and pressure of the water within the globe. The plug comprises a peripheral wall adapted to sealingly engage the skirt of the globe having an upper end thereof with two or more supports extended upward therefrom for supporting an object within the container; and a flexible diaphragm having an upper surface and a recessed channel around the periphery thereof connected to the wall and extending across the upper end of the wall.

10 Claims, 2 Drawing Sheets

SEALING PLUG FOR A WATER GLOBE

BACKGROUND OF THE INVENTION

The invention relates to a liquid filled container referred to as a "water globe" or "snow globe"; and more particularly, to an improved sealing plug for such a container.

A conventional water globe is illustrated in FIG. 1 and comprises a transparent crystalline spherical globe 10 that has a large circular opening 12 at the bottom thereof with an extended cylindrical skirt 14. The globe is filled with a liquid, primarily water sometimes including an alcohol anti-freeze mixture, and is sealed at the skirt with a hollow cylindrical rubber plug 16. The plug has a cylindrical wall 18 and a circular flat upper surface 20 that supports a small decorative ornament 22 within the globe. By means of the water and the convex lens effect of the sphere, the small ornament within the water globe generates an enlarged view that appears to fill the globe. The ornament is typically mounted on a plastic disc 24 that is securely glued to the upper surface of the plug. The liquid usually further includes tiny suspensible particles 26, so that when the globe is shaken, the particles are dynamically suspended in the liquid and momentarily provide the illusion of a snowy scene around the ornament. Some snow globes include motors or pumps to continuously move the ornament or agitate the fluid to provide an interesting display.

The water globe is typically produced utilizing a large liquid filled tank. The globe is inverted over the tank and the suspensible particles are inserted into the globe; the globe is then submersed and filled with the liquid; while submersed, the ornament/plug assembly is inserted into the skirt of the opening, without entrapping any air bubbles. The filled globes are then removed from the tank, turned right side up and supported on the base 28 of the skirt, or further mounted into an ornamental base 30. The inner wall of the skirt of the globe usually has an annular concave contour 32, and the wall of the plug has a complementary convex contour to retain the plug within the skirt with a watertight seal.

Any air bubbles discovered within the filled globe during production are considered unacceptable and the finished part is rejected, scraped, or reworked. Any air bubbles that occur after shipment may render the globe impossible to sell or result in a dissatisfied customer. A particular problem can occur due to temperature and volume changes that effect the pressure of the liquid within the globe. Water has an expansion relationship $V_2=0.00115\ V_1\ \Delta t$; and a pressure relationship $P_1\ V_1/T_1=P_2\ V_2/T_2$, and for a globe having a fixed volume where $V_1=V_2$, then $P_2=P_1\ T_2/T_1$. The globes are usually sealed at a temperature of about 25° C. However, during shipment, the globes may experience multiple temperature swings whereby high temperatures causes the internal pressure to increase, colder temperatures causes the internal pressure to decrease, and freezing temperatures also cause the volume to expand. The upper surface 20 of the conventional rubber plug 16 is thick and stiff, and the plastic disc 24 bonded thereto results in a very rigid seal, and therefore, the globe has a confined, fixed volume. During thermal expansion of the liquid within the fixed volume, the internal pressure can force a small quantity of liquid around the wall of the sealing plug and out of the container. The seal otherwise remains watertight; however, when the temperature is subsequently lowered, the liquid volume decreases (and is minimized at about 4° C.) creating a slight negative pressure or vacuum within the container, and in some cases air is drawn around the wall of the plug into the globe to balance the pressure. Once inside the container, the air bubbles cannot be easily removed and float to the top of the globe resulting in an unacceptable appearance.

In view of the foregoing, it is an object of the present invention to provide a means to normalize the pressure within a water globe during changes in internal volume and prevent the formation of air bubbles within the globe.

It is another object to provide a sealing plug that can expand and contract with changes in volume of the liquid within a water globe and prevent the formation of air bubbles within the globe.

SUMMARY OF THE INVENTION

The foregoing objects are accomplished by an improved sealing plug for a water globe having a lower opening therein with an extended skirt thereon, having a fixed peripheral portion for sealing the container and supporting an object within the container and having a flexible diaphragm adapted to adjust for changes in volume and pressure of the water within the globe. The plug comprises a peripheral wall adapted to sealingly engage the skirt of the globe having an upper end thereof with two or more supports extended upward therefrom for supporting an object within the container, and a flexible diaphragm having an upper surface and a recessed channel around the periphery thereof connected to the wall and extending across the upper end of the wall.

In another embodiment, the diaphragm of the sealing plug further includes an aperture therein, for sealingly engaging an object extended through the plug into the globe.

BRIEF DESCRIPTION OF THE DRAWINGS

While the novel features of the invention are set forth in the appended claims, the invention will be better understood along with other features thereof from the following detailed description taken in conjunction with the drawings, in which:

DETAILED DESCRIPTION OF THE INVENTION

Figure 1:
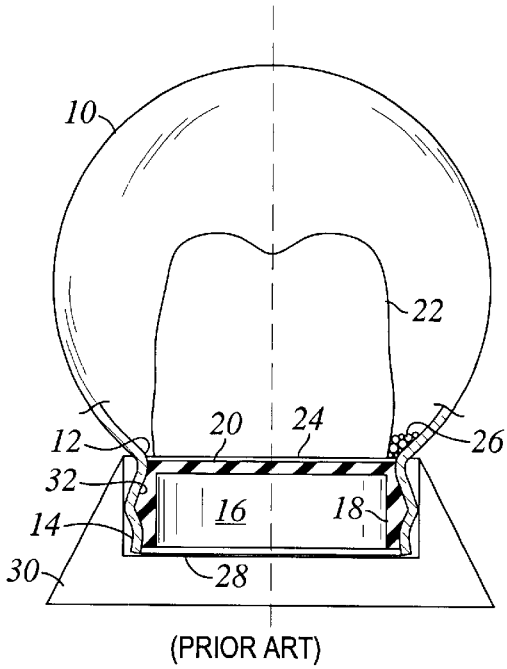
FIG. 1 is a front elevational view (shown partially in cross section) of a typical water globe and sealing plug of the prior art.
Figure 2:
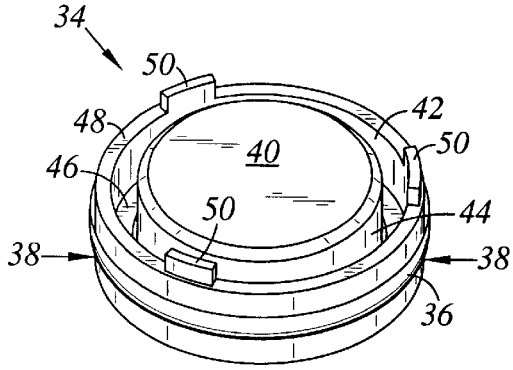
FIG. 2 is an upper front isometric view of the sealing plug of the present invention.
Figure 3:
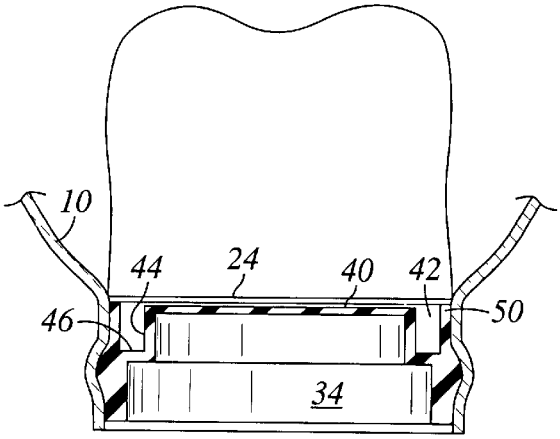
FIG. 3 is a view similar to FIG. 1 of the present invention in a minimum volume contracted orientation.
Figure 4:
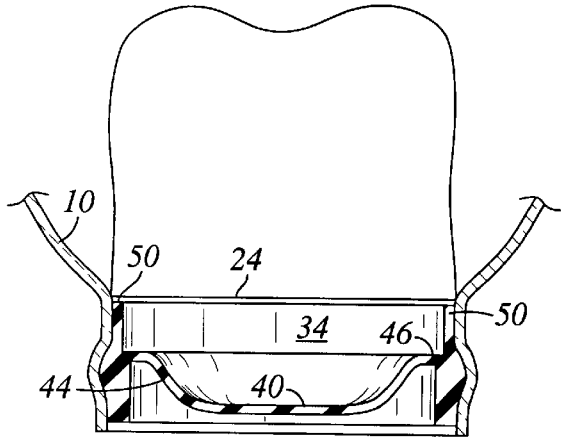
FIG. 4 is a view similar to FIG. 3 of the present invention in maximum volume expanded orientation.

Referring now to FIGS. 2, there is illustrated a preferred embodiment of a sealing plug 34 of the present invention. The plug is utilized to seal a liquid filled container, such as the water globe 10 (as discussed in reference to the prior art of FIG. 1) as illustrated in FIGS. 3 and 4.

Water globes are produced in various sizes, and by means of example, the sealing plug of the present invention is illustrated and described in reference to a water globe 10 having a diameter of about 100 mm. The globe is typically formed of crystalline glass about 1 mm thick having a lower circular opening 12 of about 60 mm in diameter with a cylindrical skirt 14 extended about 20 mm below the opening. The inner surface of the cylindrical skirt includes an annular concave contour 32 for retaining the plug, and the bottom end of the skirt provides a suitable base 28 for supporting the globe.

The plug 34 is suitable molded of natural rubber or synthetic elastomeric compound having a generally cylindrical peripheral wall 36 having a length of about 25 mm, and having a contour and diameter 38 corresponding to the inner contour and diameter of the skirt, and adapted to sealingly engage the shirt of the globe. The wall is relatively stiff having an average thickness of about 5 mm. The plug is enclosed by a flexible circular diaphragm 40 having an upper surface including a recessed channel 42 around the periphery thereof; with the recessed channel formed by a downward flange 44 connected to the wall by an annular flange 46. The depth and width of the channel are a matter of design choice, based upon the desired amount of flexibility and volume compensation required for the globe. It was found that a channel width of about 10 mm with the depth about one-half the height of the wall (12 mm) provides good flexibility and ample volume compensation for the globe. The diaphragm 40 and the recessed channel 42 are relatively flexible having a thickness of about 1 mm.

The wall utilizes its upper end 48 for supporting the internal ornament 22 that is bonded to the plastic disc 24. The upper end can be circular and continuous or have a series of extended supports for supporting the ornament. As shown particularly in FIG. 2, the upper end suitably includes three extended supports 50 that are securely bonded to the underside of the plastic disc, and the disc is otherwise free and independent of the flexible diaphragm 40. The three extended supports also readily facilitate the internal liquid to be in contact with the upper surface of the diaphragm. The independent flexible diaphragm is a key feature to the proper function of the plug of the present invention.

Referring particularly to FIG. 3, the plug is illustrated in the "as molded" configuration with the internal liquid (and internal pressure) acting on the upper surface of the plug. This illustrated configuration indicates the minimum internal volume and pressure within the globe.

FIG. 4 illustrates the flexibility and range of the diaphragm of the plug, to expand the internal volume of the globe to normalize any internal pressure that may be created by extreme environmental conditions. Any internal positive pressure on the diaphragm 40 and recessed channel 42 causes the diaphragm to initially flex and bulge downwardly to normalize the volume of the globe; under more extreme internal pressure, the diaphragm can pivot about the annular flange 46 and invert the (downward) flange 44 into an upward flange to significantly increase the volume within the globe.

The plug as illustrated in this example has been successfully tested in extreme environmental conditions ranging from about 70° C. to about −17° C. with no leaks or introduction of air bubbles.

It was also experimentally noted that during insertion of the bonded, rigid nosed prior art plug 16 that the liquid initially captured between the end of the plug/ornament assembly and the base of the skirt, was readily expelled around the wall as the plug was seated; this resulted in normalized internal pressure at 25° C. As the globe cools to room temperature, this creates a negative internal pressure within the globes as manufactured, so any additional decrease in temperature during shipping only further produces a vacuum within the globe. However, it was discovered that during insertion of the plug 34 of the present invention, the recessed channel 42 and the natural flexibility of the independent diaphragm 40 captured some of the liquid initially trapped by the upper surface of the plug, and resulted in a little extra water volume as the plug was seated into the globe. The extra water volume in the bulged diaphragm produced a positive internal pressure at 25° C. as manufactured, and was found to be advantageous as the globes were normalized to room temperature.

Figure 5:
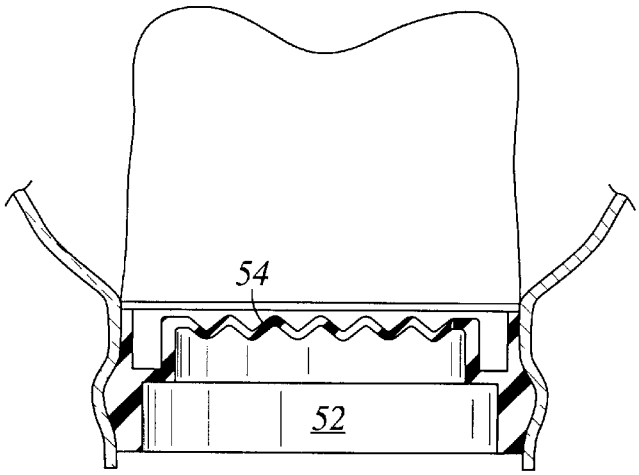
FIG. 5 is a side elevational view in cross section illustrating another embodiment of the present invention.

FIG. 5 illustrates an example of another embodiment of a sealing plug 52 of the present invention having a diaphragm including a plurality of annular convolutions 54 to facilitate the flexibility and volume compensation of the sealing plug. A variety of related U channel, V channel or semi-circular convolution shapes could be utilized with the diaphragm of the present invention.

Figure 6:
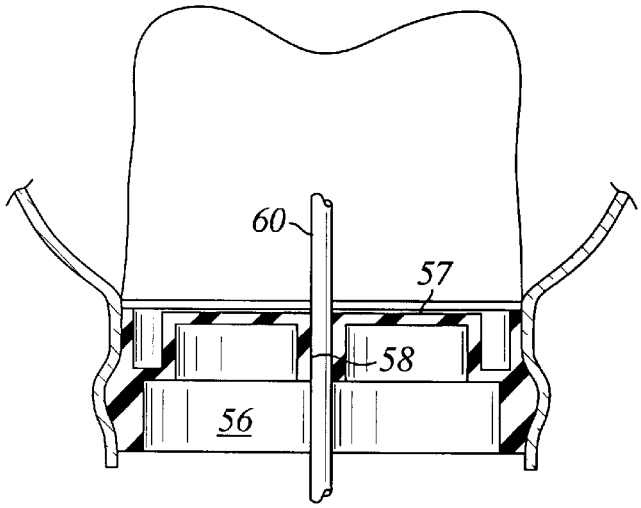
FIG. 6 is a side elevational view in cross section illustrating another embodiment of the present invention including an aperture for a shaft, light tube or air tube into the interior of the globe.

FIG. 6 illustrates an example of another embodiment of a sealing plug 56 of the present invention wherein the upper surface 57 of the diaphragm includes an aperture 58 for sealingly engaging a shaft or tube 60 utilized for rotating the ornament or agitating the liquid within the globe.

Figure 7:
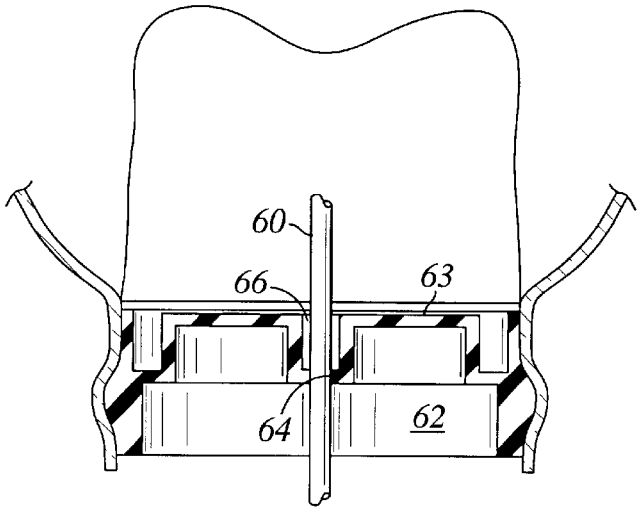
FIG. 7 is a side elevational view in cross section illustrating another embodiment of the present invention including an aperture for a shaft, light tube or air tube into the interior of the globe.

FIG. 7 illustrates an example of another embodiment of a sealing plug 62 of the present invention wherein the upper surface 63 of the diaphragm includes an aperture 64 for sealingly engaging a shaft or tube 60 utilized for rotating the ornament or agitating the liquid within the globe. The diaphragm further includes another recessed channel 66 so that the diaphragm can further deflect and rotate independently from the aperture to compensate for volume changes within the globe.

The sealing plug of the present invention can be adapted to seal a liquid filled container having a circular, rectangular or irregular opening and extended skirt; and can be adapted for other liquid filled containers as well as water globes.

While specific embodiments and examples of the present invention have been illustrated and described herein, it is realized that modifications and changes will occur to those skilled in the art. It is therefore to be understood that the appended claims are intended to cover all such modifications and changes as fall within the spirit and scope of the invention.

What is claimed is:

1. A sealing plug, for a liquid-filled container having a lower opening therein with an extended skirt thereon, having a fixed peripheral portion for sealing the container and supporting an object within the container and having a flexible diaphragm for adjusting to changes in volume and pressure of the liquid within the container, said plug comprising:

a peripheral wall for sealingly engaging the skirt of the container and having an upper end thereof with two or more supports extended upward therefrom for supporting an object within the container, and a flexible diaphragm having an upper surface and a recessed annular channel around the periphery thereof connected to said wall and extending across the upper end of said wall.

2. The sealing plug as defined in claim 1, wherein said recessed channel includes a flange extended downwardly from the upper surface and connected to the wall by an annular flange.

3. The sealing plug as defined in claim 2, wherein the depth of the recessed channel is about one-half the height of said wall and said annular flange is connected at about the center of said wall.

4. The sealing plug as defined in claim 1, wherein said diaphragm further includes at least one annular corrugation.

5. The sealing plug as defined in claim 1, wherein the upper surface of said diaphragm further includes an aperture for sealingly engaging an object extended through the plug into the container.

6. The sealing plug as defined in claim 5, wherein the upper surface of said diaphragm further includes a second recessed annular channel extended about said aperture.

7. A sealing plug, for a water globe having a lower circular opening therein with an extended cylindrical skirt thereon, having a fixed peripheral portion for sealing the globe and supporting an object within the globe and having a flexible diaphragm for adjusting to changes in volume and pressure of the water within the globe, said plug comprising:

a cylindrical peripheral wall for sealingly engaging the skirt of the globe and having an upper end thereof with two or more supports extended upward therefrom for supporting an object within the container; and a flexible diaphragm having an upper surface and a recessed channel around the periphery thereof connected to said wall and extending across the upper end of said wall.

8. The sealing plug as defined in claim 7, wherein said recessed channel includes a flange extended downwardly from the upper surface and connected to the wall by an annular flange.

9. The sealing plug as defined in claim 8, wherein the depth of the recessed channel is about one-half the height of said wall and connected at about the midpoint of said wall.

10. The sealing plug as defined in claim 8, wherein the upper surface of said diaphragm further includes an aperture for sealingly engaging a shaft extended through the plug into the globe.

* * * * *